United States Patent [19]

Grimhall et al.

[11] Patent Number: 4,516,614

[45] Date of Patent: May 14, 1985

[54] METHOD OF SLICING VENEER

[75] Inventors: Carl G. Grimhall, Djursholm; Olav Hoel, Knislinge, both of Sweden

[73] Assignee: Tarkett AB, Tonneby, Sweden

[21] Appl. No.: 500,887

[22] Filed: Jun. 3, 1983

[30] Foreign Application Priority Data

Nov. 3, 1982 [SE] Sweden ..... 8206810

[51] Int. Cl.[3] ..... B27L 5/06

[52] U.S. Cl. ..... 144/364; 144/380; 144/369; 144/178

[58] Field of Search ..... 144/209 R, 178, 364, 144/369, 380

[56] References Cited

U.S. PATENT DOCUMENTS 2,615,484 10/1952 Roberge ..... 144/369

4,222,421 9/1980 Walser et al. ..... 144/364

4,362,197 12/1982 Wick et al. ..... 144/364

FOREIGN PATENT DOCUMENTS 495206 2/1976 U.S.S.R. ..... 144/178

*Primary Examiner*—Francis S. Husar

*Assistant Examiner*—Jorji M. Griffin

*Attorney, Agent, or Firm*—Karl W. Flocks; Sheridan Neimark

[57] ABSTRACT

In veneer slicing, the surface portion of the log or block to be sliced is heated but to a relatively shallow depth. Heating preferably is effected by infrared radiation, whereby the large hot water vats at present in use can be dispensed with, and a veneer of very high quality is obtained at lower cost and with a minimum of waste.

7 Claims, 1 Drawing Figure

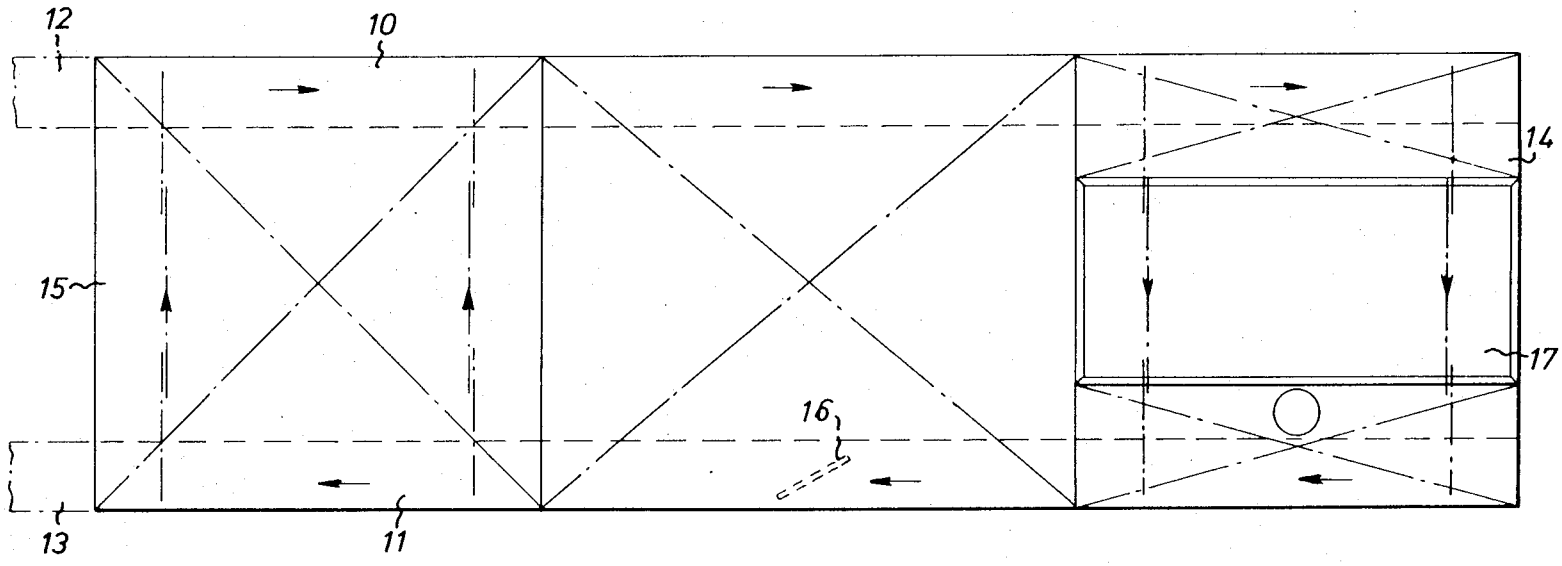
14
17
16
10
11
12
15
13

METHOD OF SLICING VENEER

The present invention relates to a method of slicing veneer by moving logs and at least one veneer knife relative to one another in the longitudinal or transverse direction of the logs.

BACKGROUND OF THE INVENTION

It has long been known to steam wood in order to soften the wood and improve its workability for veneer slicing. As an alternative to steaming, the wood can be soaked in hot water. The general opinion has been that the steamed or soaked log has absorbed large quantities of water and therefore has softened. However, recent research has shown that the wood absorbs but a few percent of water during steaming and soaking. What actually happens is that the lignin of the wood (the natural binder of the wood) is softened. One of the physical properties of lignin is that it softens at a temperature of about 65° C. and more, depending upon the wood species. The steaming and soaking of wood brings several disadvantages, in spite of the fact that veneer producers have developed special techniques for controlling temperature curves etc. Soaked wood absorbs a certain amount of moisture, whereas steamed wood usually is dried out. Both methods produce stresses in the log which result in crack formation.

Naturally, it is desired to prevent such crack formation as far as possible, and also to affect the knots as little as possible in order to prevent the knots from falling out. A further disadvantage of the above-mentioned methods is the long heating time which is required in order to avoid too great a difference in temperature between the outer and inner parts of the log. As a result, the outer parts of the log will be subjected to heavy heat loads. A certain defibration (bursting of the wood cells) and leaching of lignin and rosin substances occurs, for which reason the veneer will be unnecessarily brittle and sensitive to further processing and handling. Furthermore, some species of wood are sensitive to steaming and soaking. Unless the pH is maintained at a value favourable to the wood, discoloration or other color changes may occur.

It has been attempted to slice veneer without heating the log. This is possible with thin veneer on a recently felled log under favourable conditions, but this technique subjects the veneer knife (the slicing tool) to hard wear and usually does not give a veneer of acceptable quality.

As is well known, there are two basic methods of producing veneer. The first method is by rotary cutting, which means that the log is clamped between two centers and rotated about its axis, while a knife is moved at a constant speed towards the log center, and more or less continuous veneer sheets are formed. By the other method, the so-called slicing method, the log is clamped on a bed, and a long knife slices a thin veneer sheet substantially transversely of the longitudinal direction of the log. When the knife returns to initial position, the log is advanced a distance corresponding to the veneer thickness. In a modification of this slicing method, the knife is stationary, while the log moves. Both the rotary cutting method and the slicing method require that the log is pretreated by heating.

Recently, another method of producing veneer has been developed, in which the log is moved longitudinally across an inclined knife, whereby veneer of desired thickness is obtainable. A reciprocating movement is imparted to the log, or the machine is provided with an additional conveying path for returning the log, and it is possible to have several logs in circulation at the same time. Also in this type of machine, the logs usually have been steamed or soaked.

If it is desired to prevent crack formation, steaming or soaking treatment may be replaced by the per se known technique which is used in drying wood and which implies that the water molecules within the wood are set in motion by electronic means, for instance by placing the log in an inductive or capacitative field. By suitably adapting the current and the voltage, a relatively uniform heating of the log can be achieved without any appreciable crack formation. The same effect is obtainable by placing the log in a field of microwaves. Both methods suffer from the disadvantage that the costs of installation are very high and that it is extremely difficult to maintain a homogeneous temperature throughout the log and to prevent drying-out of the log.

SUMMARY OF THE INVENTION

It is the object of the present invention to obviate the need for large and expensive water vats or steaming plants for processing whole logs or blocks, and to provide a novel method of heat-softening wood for veneer slicing in a relatively simple and inexpensive manner eliminating the risk of crack formation or staining of the wood.

To this end, the log surface portion to be sliced is heated immediately before slicing to a depth insignificantly greater than the thickness of the veneer to be sliced.

DESCRIPTION OF THE INVENTION

The invention will now be described in more detail with reference to the accompanying drawing schematically illustrating an embodiment.

In the drawing, two parallel conveyors 10 and 11 are positioned at a distance from one another and move in opposite directions, as shown by the arrows. The conveyor 10 has an infeed part 12, and the conveyor 11 has an outfeed part 13. Between the conveyor ends (to the right in the drawing) a transverse conveyor 14 is moving in a direction from the conveyor 10 to the conveyor 11, and between the opposite ends of the conveyors 10, 11 another transverse conveyor 15 is moving from the conveyor 11 to the conveyor 10. The conveyors 10, 11, 14 and 15 are arranged to receive logs or wooden blocks (not shown) which are supplied at 12 and then circulated by means of the four conveyors. If a log or portion thereof must be removed, this is done via the part 13 on which the log is discharged from the conveyor 11.

When the logs are travelling along the conveyor 11, their underside is brought into contact with a veneer knife 16 in per se known manner for slicing a veneer. Before the slicing operation, the log must be heated, and this is done by bringing the log into contact with a heat source 17 when the log is conveyed by the conveyor 14.

The heat source preferably is in the form of a cassette emitting infrared radiation which is caused to impinge upon the surface of the log which then is brought into contact with the knife 16 for veneer slicing. The penetration depth of the infrared radiation is controlled by means of the velocity of motion of the conveyor 14. The penetration depth preferably is so selected that it corresponds to or insignificantly exceeds the thickness of the veneer which is then sliced by means of the knife 16. The penetration depth must, of course, be at least equal to the veneer thickness, but it is in the nature of things that, in actual practice, it is difficult, if not impossible, constantly and exactly to maintain this depth, and for this reason the depth is defined as being "insignificantly" greater, by which is meant that heating is carried out in such a manner that the lower limit, i.e. the veneer thickness, will definitely be obtained, and this means that this limit normally is slightly exceeded. In other words, the penetration depth may, in practice, amount to 1–5 times the veneer thickness, depending on how thick the veneer is. It should be pointed out, however, that the cost of this operation will increase proportionally to the increase in penetration depth.

The heat source need not necessarily emit infrared radiation, and other radiation may also be utilized, provided that the heat reaches the desired depth in a relatively short time. It is also possible to replace the radiation source by a vat containing a high-boiling liquid, such as polyethylene glycol, although in such a case the veneer slicing equipment will be somewhat more complicated, but nevertheless simpler than present-day equipment because, as has been explained above, only that part of the log which comes into contact with the knife need be treated. Instead of letting the log float in a vat, it is also possible to spray the log to be sliced with hot liquid under pressure. The heat source may, of course, be positioned in a different manner than indicated above, and combinations of different heat sources are conceivable.

In the above-mentioned embodiment, the veneer is sliced in the longitudinal direction of the logs, but it is also possible to slice the veneer transversely of the logs by placing an elongate veneer knife along one or the other transverse conveyor 14 or 15. The invention is also applicable to rotary cutting of veneer, in which case the heat radiator covers part of the circumference of the rotating log along the entire slicing length. Prior to slicing, the log is rotated for a predetermined period of time in front of the heat radiator which later, during the slicing operation, serves to maintain the heat in the surface layer.

According to the above description, the logs are moving past a stationary knife 16, but it is, of course, also possible to provide a slicing and irradiating device that is movable along stationary logs.

As has been pointed out before, it is not necessary to supply moisture to lumber that has been felled fairly recently and has not been dried out to excess. A series of tests have shown that the embodiment of the heat source illustrated in the drawing imparts to oak (quercus robur) a temperature of about 80° C. after 25–27 seconds at a depth of 3–4 mm in the log, which is accomplished without staining and crack formation in the surface. Furthermore, a higher moisture ratio inwardly in the log is obtained depending upon the temperature gradient. However, the moisture dissipation is comparatively moderate because the infrared radiation is intense at the surface and reaches but a few millimeters down into the surface of the wood. As is well known, wood is a poor heat conductor. As a result, there is obtained a moisture ratio concentration in the layer adjacent the surface of the cut.

In some cases, it has proved advantageous immediately after the veneer slicing operation to treat, for instance by spraying, the surface of the cut with water or other liquid in order to increase the heat conductivity and, possibly, to reduce drying-out.

By adapting the size of the radiation ramp, the effect and the feed velocity to the wood species, the desired heating depth and slicing velocity, the present invention produces a veneer of very high quality at low cost, and waste due to crack formation is kept at a minimum.

What we claim and desire to secure by Letters Patent is:

1. A method of slicing veneer by moving logs and at least one veneer knife relatively to one another in the longitudinal or transverse direction of the logs, wherein the log surface portion to be sliced is heated with dry heat for no more than about 27 seconds and to a temperature of about 80° C., immediately before slicing, said heating being controlled to a depth insignificantly greater than the thickness of the veneer to be sliced.

2. A method as claimed in claim 1, wherein the heating depth amounts to 1–5 times the veneer thickness.

3. A method as claimed in claim 1, wherein the surface portion to be sliced is heat-irradiated.

4. A method as claimed in claim 3, wherein said surface portion is heat-irradiated with infrared light.

5. A method as claimed in claim 3, wherein said slicing is effected by rotary cutting, said heating being effected by rotating the log in front of a heat radiator for a pre-determined period of time prior to said rotary slicing; and then, during the slicing operation, maintaining said heating during said rotary cutting.

6. A method as claimed in claim 1, in which the logs are fed in succession past a veneer knife, wherein the log along a part of its travelling distance is floated in a vat, such that the surface portion to be sliced is in contact with the hot liquid.

7. A method as claimed in claim 1, wherein said control of said heating to insure heat penetration to a depth only insignificantly greater than the thickness of the veneer to be sliced, is effected by controlling the time of contact of the log surface portion to be sliced with a source of said heat.

* * * * *